US008201892B2

(12) United States Patent
Hall et al.

(10) Patent No.: US 8,201,892 B2
(45) Date of Patent: Jun. 19, 2012

(54) HOLDER ASSEMBLY

(76) Inventors: David R. Hall, Provo, UT (US); Jeff Jepson, Spanish Fork, UT (US); Tyson J. Wilde, Spanish Fork, UT (US)

( * ) Notice: Subject to any disclaimer, the term of this patent is extended or adjusted under 35 U.S.C. 154(b) by 520 days.

(21) Appl. No.: 11/953,424

(22) Filed: Dec. 10, 2007

(65) Prior Publication Data

US 2008/0088172 A1 Apr. 17, 2008

Related U.S. Application Data

(63) Continuation-in-part of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/953,424 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/197* (2006.01)

(52) U.S. Cl. ..... 299/102; 299/113

(58) Field of Classification Search ..... 299/104, 299/107, 102, 111, 113
See application file for complete search history.

(56) References Cited

U.S. PATENT DOCUMENTS 465,103 A 12/1891 Wegner (Continued)

FOREIGN PATENT DOCUMENTS

| | | |
|---|---|---|
| DE | 3 307 910 | 9/1984 |
| DE | 3 431 495 | 3/1986 |
| DE | 3500261 | 7/1986 |
| DE | 3818213 | 11/1989 |
| DE | 4039217 | 6/1992 |

(Continued)

*Primary Examiner* — John Kreck
(74) *Attorney, Agent, or Firm* — Philip W. Townsend, III

(57) ABSTRACT

In one aspect of the invention, a holder assembly comprises a connection block having a block bore extending from a first opening proximate a first end of the assembly to a second opening proximate a second end of the assembly. The block is adapted for connection to a driving mechanism. An extension element is disposed in the block bore and protrudes from the first opening of the block bore. The extension element comprises a central extension bore having a longitudinal length. An attachment mechanism is disposed within the central extension bore of the extension element and is disposed proximate the second end of the assembly.

22 Claims, 7 Drawing Sheets

U.S. PATENT DOCUMENTS

| | | | | |
|---|---|---|---|---|
| 616,118 | A | | 12/1898 | Kunhe |
| 946,060 | A | | 1/1910 | Looker |
| 1,116,154 | A | | 11/1914 | Stowers |
| 1,183,630 | A | | 5/1916 | Bryson |
| 1,189,560 | A | | 7/1916 | Gondos |
| 1,360,908 | A | | 11/1920 | Everson |
| 1,387,733 | A | | 8/1921 | Midgett |
| 1,460,671 | A | | 7/1923 | Hebsacker |
| 1,544,757 | A | | 7/1925 | Hufford et al. |
| 1,821,474 | A | | 9/1931 | Mercer |
| 1,879,177 | A | | 9/1932 | Gault |
| 2,004,315 | A | | 6/1935 | Fean |
| 2,054,255 | A | | 9/1936 | Howard |
| 2,064,255 | A | | 12/1936 | Garfield |
| 2,124,438 | A | | 7/1938 | Struk |
| 2,169,223 | A | | 8/1939 | Christian |
| 2,218,130 | A | | 10/1940 | Court |
| 2,255,650 | A | * | 9/1941 | Burke ..... 411/44 |
| 2,320,136 | A | | 5/1943 | Kammerer |
| 2,466,991 | A | | 4/1949 | Kammerer |
| 2,540,464 | A | | 2/1951 | Stokes |
| 2,544,036 | A | | 3/1951 | Kammerer |
| 2,720,392 | A | * | 10/1955 | Cartlidge ..... 299/103 |
| 2,755,071 | A | | 7/1956 | Kammerer |
| 2,776,819 | A | | 1/1957 | Brown |
| 2,819,043 | A | | 1/1958 | Henderson |
| 2,838,284 | A | | 6/1958 | Austin |
| 2,894,722 | A | | 7/1959 | Buttolph |
| 2,901,223 | A | | 8/1959 | Scott |
| 2,963,102 | A | | 12/1960 | Smith |
| 2,989,295 | A | | 6/1961 | Prox, Jr. |
| 3,135,341 | A | | 6/1964 | Ritter |
| 3,254,392 | A | | 6/1966 | Novkov |
| 3,294,186 | A | | 12/1966 | Buell |
| 3,301,339 | A | | 1/1967 | Pennebaker, Jr. |
| 3,468,553 | A | | 1/1967 | Ashby et al. |
| 3,336,081 | A | | 8/1967 | Griffin |
| 3,342,531 | A | | 9/1967 | Krekeler |
| 3,342,532 | A | | 9/1967 | Krekeler |
| 3,379,264 | A | | 4/1968 | Cox |
| 3,397,012 | A | | 8/1968 | Krekeler |
| 3,397,013 | A | | 8/1968 | Krekeler |
| 3,429,390 | A | | 2/1969 | Bennett |
| 3,429,617 | A | * | 2/1969 | Lauber ..... 299/103 |
| 3,493,165 | A | | 2/1970 | Schonfeld |
| 3,498,677 | A | | 3/1970 | Morrow |
| 3,512,838 | A | | 5/1970 | Kniff |
| 3,583,504 | A | | 6/1971 | Aalund |
| 3,627,381 | A | | 12/1971 | Krekeler |
| 3,650,565 | A | | 3/1972 | Kniff |
| 3,655,244 | A | | 4/1972 | Swisher |
| 3,746,396 | A | | 7/1973 | Radd |
| 3,751,115 | A | | 8/1973 | Proctor |
| 3,764,493 | A | | 10/1973 | Rosar et al. |
| 3,767,266 | A | | 10/1973 | Krekeler |
| 3,778,112 | A | | 12/1973 | Krekeler |
| 3,801,158 | A | | 4/1974 | Radd et al. |
| 3,807,804 | A | | 4/1974 | Kniff |
| 3,830,321 | A | | 8/1974 | McKenry |
| 3,833,265 | A | | 9/1974 | Elders |
| 3,865,437 | A | | 2/1975 | Crosby |
| 3,932,952 | A | | 1/1976 | Helton et al. |
| 3,942,838 | A | | 3/1976 | Bailey et al. |
| 3,945,681 | A | | 3/1976 | White |
| 3,957,307 | A | | 5/1976 | Varda |
| 3,960,223 | A | | 6/1976 | Kleine |
| 4,005,914 | A | | 2/1977 | Newman |
| 4,006,936 | A | | 2/1977 | Crabiel |
| 4,081,042 | A | | 3/1978 | Johnson et al. |
| 4,084,856 | A | | 4/1978 | Emmerich et al. |
| 4,098,362 | A | | 7/1978 | Bonnice |
| 4,106,577 | A | | 8/1978 | Summers |
| 4,109,737 | A | | 8/1978 | Bovenkerk |
| 4,149,753 | A | | 4/1979 | Stoltz et al. |
| 4,156,329 | A | | 5/1979 | Daniels |
| 4,199,035 | A | | 4/1980 | Thompson |
| 4,201,421 | A | | 5/1980 | Den Besten |
| 4,247,150 | A | | 1/1981 | Wrulich et al. |
| 4,251,109 | A | | 2/1981 | Roepke |
| 4,268,089 | A | | 5/1981 | Spence et al. |
| 4,277,106 | A | | 7/1981 | Sahley |
| 4,307,786 | A | | 12/1981 | Evans |
| 4,337,980 | A | | 7/1982 | Krekeler |
| 4,397,362 | A | | 8/1983 | Dice et al. |
| 4,416,339 | A | | 11/1983 | Baker et al. |
| 4,439,250 | A | | 3/1984 | Acharya |
| 4,448,269 | A | | 5/1984 | Ishikawa et al. |
| 4,453,775 | A | | 6/1984 | Clemmow |
| 4,465,221 | A | | 8/1984 | Schmidt |
| 4,484,644 | A | | 11/1984 | Cook |
| 4,484,783 | A | | 11/1984 | Emmerich |
| 4,485,221 | A | | 11/1984 | Krueger et al. |
| 4,489,986 | A | | 12/1984 | Dziak |
| 4,497,520 | A | | 2/1985 | Ojanen |
| 4,531,592 | A | | 7/1985 | Hayatdavoudi |
| 4,537,448 | A | | 8/1985 | Ketterer |
| 4,542,942 | A | | 9/1985 | Zitz et al. |
| 4,566,545 | A | | 1/1986 | Story et al. |
| 4,579,491 | A | * | 4/1986 | Kull ..... 411/43 |
| 4,583,786 | A | | 4/1986 | Thorpe et al. |
| 4,627,665 | A | | 12/1986 | Ewing |
| 4,647,111 | A | | 3/1987 | Bronder et al. |
| 4,660,890 | A | | 4/1987 | Mills |
| 4,669,786 | A | | 6/1987 | Morgan et al. |
| 4,678,237 | A | | 7/1987 | Collin |
| 4,682,987 | A | | 7/1987 | Brady |
| 4,688,856 | A | | 8/1987 | Elfgen |
| 4,694,918 | A | | 9/1987 | Hall |
| 4,702,525 | A | | 10/1987 | Sollami et al. |
| 4,725,098 | A | | 2/1988 | Beach |
| 4,728,153 | A | | 3/1988 | Ojanen et al. |
| 4,729,603 | A | | 3/1988 | Elfgen |
| 4,736,533 | A | | 4/1988 | May et al. |
| 4,746,379 | A | | 5/1988 | Rabinkin |
| 4,765,686 | A | | 8/1988 | Adams |
| 4,765,687 | A | | 8/1988 | Parrott |
| 4,776,862 | A | | 10/1988 | Wiand |
| 4,804,231 | A | | 2/1989 | Buljan et al. |
| 4,811,801 | A | | 3/1989 | Salesky et al. |
| 4,836,614 | A | | 6/1989 | Ojanen |
| 4,850,649 | A | | 7/1989 | Beach et al. |
| 4,880,154 | A | | 11/1989 | Tank |
| 4,893,875 | A | | 1/1990 | Lonn et al. |
| 4,907,665 | A | | 3/1990 | Kar et al. |
| 4,921,310 | A | | 5/1990 | Hedlund et al. |
| D308,683 | S | | 6/1990 | Meyers |
| 4,932,723 | A | | 6/1990 | Mills |
| 4,940,288 | A | | 7/1990 | Stiffler |
| 4,944,559 | A | | 7/1990 | Sionnet |
| 4,951,762 | A | | 8/1990 | Lundell |
| 4,956,238 | A | | 9/1990 | Griffin |
| 4,962,822 | A | | 10/1990 | Pascale |
| 5,007,685 | A | | 4/1991 | Beach et al. |
| 5,009,273 | A | | 4/1991 | Grabinski |
| 5,011,515 | A | | 4/1991 | Frushour |
| 5,018,793 | A | | 5/1991 | Den Besten |
| 5,038,873 | A | | 8/1991 | Jurgens |
| 5,088,797 | A | | 2/1992 | O'Neill |
| 5,106,166 | A | | 4/1992 | O'Neill |
| 5,112,165 | A | | 5/1992 | Hedlund |
| 5,119,714 | A | | 6/1992 | Scott et al. |
| 5,141,063 | A | | 8/1992 | Quesenbury |
| 5,141,289 | A | | 8/1992 | Stiffler |
| 5,154,245 | A | | 10/1992 | Waldenstrom |
| 5,186,892 | A | | 2/1993 | Pope |
| 5,251,964 | A | | 10/1993 | Ojanen |
| 5,261,499 | A | | 11/1993 | Grubb |
| D342,268 | S | | 12/1993 | Meyer |
| 5,303,984 | A | | 4/1994 | Ojanen |
| 5,311,654 | A | | 5/1994 | Cook |
| 5,332,051 | A | | 7/1994 | Knowlton |
| 5,332,348 | A | | 7/1994 | Lemelson |
| 5,361,859 | A | | 11/1994 | Tibbitts |
| 5,374,111 | A | | 12/1994 | Den Besten et al. |
| 5,415,462 | A | | 5/1995 | Massa |
| 5,417,292 | A | | 5/1995 | Polakoff |
| 5,417,475 | A | | 5/1995 | Graham |

| | | | | |
|---|---|---|---|---|
| 5,447,208 | A | 9/1995 | Lund | |
| 5,503,463 | A | 4/1996 | Ojanen | |
| 5,507,357 | A | 4/1996 | Hult et al. | |
| 5,535,839 | A | 7/1996 | Brady | |
| 5,542,993 | A | 8/1996 | Rabinkin | |
| 5,560,440 | A | 10/1996 | Tibbitts | |
| 5,568,838 | A | 10/1996 | Struthers et al. | |
| 5,653,300 | A | 8/1997 | Lund | |
| 5,662,720 | A | 9/1997 | O'Tighearnaigh | |
| 5,678,644 | A | 10/1997 | Fielder | |
| 5,720,528 | A | 2/1998 | Ritchey | |
| 5,725,283 | A | 3/1998 | O'Neill | |
| 5,730,502 | A | 3/1998 | Montgomery, Jr. | |
| 5,732,784 | A | 3/1998 | Nelson | |
| 5,738,698 | A | 4/1998 | Kapoor | |
| 5,823,632 | A | 10/1998 | Burkett | |
| 5,837,071 | A | 11/1998 | Andersson et al. | |
| 5,842,747 | A | 12/1998 | Winchester | |
| 5,845,547 | A | 12/1998 | Sollami | |
| 5,848,657 | A | 12/1998 | Flood et al. | |
| 5,875,862 | A | 3/1999 | Jurewicz | |
| 5,884,979 | A | 3/1999 | Latham | |
| 5,890,552 | A | 4/1999 | Scott et al. | |
| 5,896,938 | A | 4/1999 | Moeny et al. | |
| 5,934,542 | A | 8/1999 | Nakamura | |
| 5,935,718 | A | 8/1999 | Demo | |
| 5,944,129 | A | 8/1999 | Jenson | |
| 5,967,250 | A | 10/1999 | Lund | |
| 5,992,405 | A | 11/1999 | Sollami | |
| 6,000,483 | A | 12/1999 | Jurewicz et al. | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,059,373 | A | 5/2000 | Wright et al. | |
| 6,065,552 | A | 5/2000 | Scott | |
| 6,102,486 | A | 8/2000 | Briese | |
| 6,113,195 | A | 9/2000 | Mercier | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,645 | B1 | 3/2001 | Anderson et al. | |
| 6,199,956 | B1 | 3/2001 | Kammerer | |
| 6,202,761 | B1 | 3/2001 | Forney | |
| 6,216,805 | B1 | 4/2001 | Lays | |
| 6,270,165 | B1 | 8/2001 | Peay | |
| 6,331,035 | B1 | 12/2001 | Montgomery, Jr. | |
| 6,332,503 | B1 | 12/2001 | Pessier et al. | |
| 6,341,823 | B1 | 1/2002 | Sollami | |
| 6,354,771 | B1 | 3/2002 | Bauschulte | |
| 6,357,832 | B1 | 3/2002 | Sollami | |
| 6,364,420 | B1 | 4/2002 | Sollami | |
| 6,371,567 | B1 | 4/2002 | Sollami | |
| 6,375,272 | B1 | 4/2002 | Ojanen | |
| 6,397,652 | B1 | 6/2002 | Sollami | |
| 6,408,959 | B2 | 6/2002 | Bertagnolli et al. | |
| 6,412,163 | B1 * | 7/2002 | Russell | 29/453 |
| 6,419,278 | B1 | 7/2002 | Cunningham | |
| 6,439,326 | B1 | 8/2002 | Huang et al. | |
| 6,460,637 | B1 | 10/2002 | Siracki et al. | |
| 6,478,383 | B1 | 11/2002 | Ojanen | |
| 6,481,803 | B2 | 11/2002 | Ritchey | |
| 6,484,826 | B1 | 11/2002 | Anderson et al. | |
| 6,499,547 | B2 | 12/2002 | Scott | |
| 6,508,516 | B1 | 1/2003 | Kammerer | |
| 6,517,902 | B2 | 2/2003 | Drake | |
| 6,533,050 | B2 | 3/2003 | Molloy | |
| 6,585,326 | B2 | 7/2003 | Sollami | |
| 6,601,454 | B1 | 8/2003 | Botnan | |
| 6,601,662 | B2 | 8/2003 | Matthias et al. | |
| 6,644,755 | B1 | 11/2003 | Kammerer | |
| 6,651,758 | B2 | 11/2003 | Xiang et al. | |
| 6,668,949 | B1 | 12/2003 | Rives | |
| 6,672,406 | B2 | 1/2004 | Beuershausen | |
| 6,685,273 | B1 | 2/2004 | Sollami | |
| 6,692,083 | B2 | 2/2004 | Latham | |
| 6,702,393 | B2 | 3/2004 | Mercier | |
| 6,709,065 | B2 | 3/2004 | Peay | |
| 6,719,074 | B2 | 4/2004 | Tsuda | |
| 6,732,817 | B2 | 5/2004 | Dewey et al. | |
| 6,732,914 | B2 | 5/2004 | Cadden et al. | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,846,045 | B2 | 1/2005 | Sollami | |
| 6,851,758 | B2 | 2/2005 | Beach | |
| 6,854,810 | B2 | 2/2005 | Montgomery, Jr. | |
| 6,861,137 | B2 | 3/2005 | Griffin et al. | |
| 6,863,352 | B2 | 3/2005 | Sollami | |
| 6,889,890 | B2 | 5/2005 | Yamazaki et al. | |
| 6,929,076 | B2 | 8/2005 | Fanuel et al. | |
| 6,938,961 | B2 | 9/2005 | Broom | |
| 6,953,096 | B2 | 10/2005 | Gledhill et al. | |
| 6,962,395 | B2 | 11/2005 | Mouthaan | |
| 6,966,611 | B1 | 11/2005 | Sollami | |
| 6,994,404 | B1 | 2/2006 | Sollami | |
| 7,118,181 | B2 | 10/2006 | Frear | |
| 7,204,560 | B2 | 4/2007 | Mercier | |
| 7,234,782 | B2 | 6/2007 | Stehney | |
| D560,699 | S | 1/2008 | Omi | |
| 7,343,947 | B1 * | 3/2008 | Sollami | 144/241 |
| 7,369,743 | B2 | 5/2008 | Watkins et al. | |
| 7,387,345 | B2 | 6/2008 | Hall et al. | |
| 7,390,066 | B2 | 6/2008 | Hall et al. | |
| 7,413,258 | B2 | 8/2008 | Hall et al. | |
| 7,992,944 | B2 | 8/2011 | Hall et al. | |
| 2001/0004946 | A1 | 6/2001 | Jensen | |
| 2002/0070602 | A1 | 6/2002 | Sollami | |
| 2002/0153175 | A1 | 10/2002 | Ojanen | |
| 2002/0175555 | A1 | 11/2002 | Mercier | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0110667 | A1 | 6/2003 | Adachi et al. | |
| 2003/0137185 | A1 | 7/2003 | Sollami | |
| 2003/0140360 | A1 | 7/2003 | Mansuy et al. | |
| 2003/0141350 | A1 | 7/2003 | Noro et al. | |
| 2003/0141753 | A1 | 7/2003 | Peay et al. | |
| 2003/0209366 | A1 | 11/2003 | McAlvain | |
| 2003/0213354 | A1 | 11/2003 | Frers | |
| 2003/0230926 | A1 | 12/2003 | Mondy et al. | |
| 2003/0234280 | A1 | 12/2003 | Cadden | |
| 2004/0026132 | A1 | 2/2004 | Hall et al. | |
| 2004/0026983 | A1 | 2/2004 | McAlvain | |
| 2004/0065484 | A1 | 4/2004 | McAlvain | |
| 2005/0035649 | A1 | 2/2005 | Mercier et al. | |
| 2005/0044987 | A1 | 3/2005 | Takayama et al. | |
| 2005/0159840 | A1 | 7/2005 | Lin | |
| 2005/0173966 | A1 | 8/2005 | Mouthaan | |
| 2006/0006727 | A1 * | 1/2006 | Frear | 299/107 |
| 2006/0086537 | A1 | 4/2006 | Dennis | |
| 2006/0086540 | A1 | 4/2006 | Griffin et al. | |
| 2006/0125306 | A1 | 6/2006 | Sollami | |
| 2006/0186724 | A1 | 8/2006 | Stehney | |
| 2006/0237236 | A1 | 10/2006 | Sreshta | |
| 2006/0261663 | A1 | 11/2006 | Sollami | |
| 2007/0013224 | A1 | 1/2007 | Stehney | |

FOREIGN PATENT DOCUMENTS

| | | |
|---|---|---|
| DE | 19821147 | 11/1999 |
| DE | 10163717 | 5/2003 |
| EP | 0 295 151 | 12/1988 |
| EP | 0412287 | 2/1991 |
| EP | 0 899 051 A1 | 3/1999 |
| EP | 1 574 309 | 9/2005 |
| GB | 2004315 | 3/1979 |
| GB | 2037223 | 7/1980 |
| GB | 2 423 319 A | 8/2006 |
| JP | 3123193 | 5/1991 |
| JP | 52-80273 | 10/1993 |
| RU | 2 079 651 | 5/1997 |

* cited by examiner

HOLDER ASSEMBLY

CROSS REFERENCE TO RELATED APPLICATIONS

This application is a continuation-in-part of U.S. patent application Ser. No. 11/947,644 filed on Nov. 29, 2007 now U.S. Pat. No. 8,007,051 which is a continuation-in-part of U.S. patent application Ser. No. 11/844,586 filed on Aug. 24, 2007 now U.S. Pat. No. 7,600,823. U.S. patent application Ser. No. 11/844,586 is a continuation- in-part of U.S. patent application Ser. No. 11/829,761, filed on Jul. 27, 2007, and is now U.S Pat. No. 7,722,127 that issued on May 25, 2010. U.S. patent application Ser. No. 11/829,761 is a continuation-in-part of U.S. patent application Ser. No. 11/773,271 filed on Jul. 3, 2007 now U.S. Pat No. 7,997,661. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007, and is now U.S. Pat. No. 7,475,948 that issued on Jan. 13, 2009. U.S. patent application Ser. No. 11/742,304 is a continuation of U.S. patent application Ser. No. 11/742,261 filed on Apr. 30, 2007, and is now U.S. Pat. No. 7,469,971 that issued on Dec. 30, 2008. U.S. patent application Ser. No. 11/742,261 is a continuation-in-part of U.S. patent application Ser. No. 11/464,008 filed on Aug. 11 , 2006, and is now U.S. Pat. No. 7,338,135 that issued on Mar. 4, 2008. U.S. patent application Ser. No. 11/464,008 is a continuation-in-part of U.S. patent application Ser. No. 11/463,998 filed on Aug. 11, 2006, and is now U.S. Pat. No. 7,384,105 that issued on Jun. 10, 2008. U.S. patent application Ser. No. 11/463,998 is a continuation-in-part of U.S. patent application Ser. No. 11/463,990 filed on Aug. 11, 2006, and is now U.S. Pat. No. 7,320,505 that issued on Jan. 22, 2008. U.S. patent application Ser. No. 11/463,990 is a continuation-in-part of U.S. patent application Ser. No. 11/463,975 filed on Aug. 11, 2006, and is now U.S. Pat. No. 7,445,294 that issued on Nov. 4, 2008. U.S. patent application Ser. No. 11/463,975 is a continuation-in-part of U.S. patent application Ser. No. 11/463,962 filed on Aug. 11, 2006, and is now U.S. Pat. No. 7,413,256 that issued on Aug. 19, 2008. The present application is also a continuation-in-part of U.S. patent application Ser. No. 11/695,672 filed on Apr. 3, 2007, and is now U.S. Pat. No. 7,396,086 that issued on Jul. 8, 2008. U.S. patent application Ser. No. 11/695,672 is a continuation-in-part of U.S. patent application Ser. No. 11/686,831 filed on Mar. 15, 2007, and is now U.S. Pat. No. 7,568,770 that issued on Aug. 4, 2009.

All of these applications are herein incorporated by reference for all that they contain.

BACKGROUND OF THE INVENTION

Many industries including the asphalt, mining, construction, drilling, and excavation industries, utilize a plurality of picks incorporated into drums. In asphalt milling, a drum supporting an array of picks may rotate such that the picks engage a paved surface causing it to break up. Examples of degradation assemblies from the prior art are disclosed in U.S. Pat. No. 6,824,225 to Stiffler, U.S. Pub. No. 2005/0173966 to Mouthaan, U.S. Pat. No. 6,692,083 to Latham, U.S. Pat. No. 6,786,557 to Montgomery, Jr., U.S. Pat. No. 3,830,321 to McKenry et al., U.S. Pub. No. 2003/0230926, U.S. Pat. No. 4,932,723 to Mills, U.S. Pub. No. 2002/0175555 to Merceir, U.S. Pat. No. 6,854,810 to Montgomery, Jr., U.S. Pat. No. 6,851,758 to Beach, which are all herein incorporated by reference for all they contain.

The picks typically have a tungsten carbide tip. Efforts have been made to extend the life of these picks. Examples of such efforts are disclosed in U.S. Patent No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

U.S. Pat. No. 6,371,567 to Sollami, U.S. Pat. No. 6,357,832 to Sollami, and U.S. Pat. No. 5,992,405 to Sollami, each of which is hereby incorporated by reference for all that it contains, disclose methods of mounting cutting tools and securing cutting tools to the mounts

BRIEF SUMMARY OF THE INVENTION

In one aspect of the invention, a holder assembly comprises a connection block having a block bore extending from a first opening proximate to a first end of the assembly to a second opening proximate to a second end of the assembly. The block is adapted for connection to a driving mechanism. For example, the driving mechanism may be a milling drum connected to the underside of a pavement milling machine or part of a milling machine. An extension element is disposed in the block bore and protrudes from the first opening of the block bore. The extension element comprises a central extension bore having a longitudinal length. An attachment mechanism is disposed within the central extension bore of the extension element and is disposed proximate to the second end of the assembly.

In some embodiments, the attachment mechanism attaches to the extension element within the block bore. The block and the extension element may be attached to one another via the attachment mechanism. In some embodiments, the attachment mechanism may radially expand at least a portion of the extension element outward to engage an inner surface of the block bore. In such embodiments, the attachment mechanism may comprise a wedge. The attachment mechanism may be inserted into the central extension bore of the extension element through the second opening of the block bore. The attachment mechanism may be adapted to interlock with the extension element. An external surface of the attachment mechanism may also comprise ridges.

A longitudinal length of the central extension bore may be at least as long as a longitudinal length of the block bore. An internal surface of the block bore may comprise outwardly tapered surfaces. The central extension bore of the extension element may comprise an opening proximate to the second end of the holder assembly. The extension element may comprise a plurality of coaxial central extension bores. One of the central extension bores may comprise an opening proximate to the first end of the holder assembly and another central extension bore may comprise an opening proximate to the second end of the holder assembly. In some embodiments, a lubricant reservoir and a pick shank may each be disposed in one of the axial central extension bores.

The extension element may also comprise slits proximate to the second end of the assembly. A split ring may be disposed between the inner surface of the central extension bore and the external surface of the extension element proximate to the second end of the holder assembly. In some embodiments, the external surface of the attachment mechanism may comprise a first set of threads that corresponds to a second set of threads disposed on an inner surface of the central extension bore. The attachment mechanism may protrude from the second opening of the block bore. The attachment mechanism may comprise an external end that protrudes out of the second opening of the block bore and contacts a surface of the block proximate the second end of the assembly. A pick shank may be disposed within the central extension bore and the pick shank may be connected to a wear-resistant impact tip.

DETAILED DESCRIPTION OF THE INVENTION AND EXEMPLARY EMBODIMENTS

Figure 1:
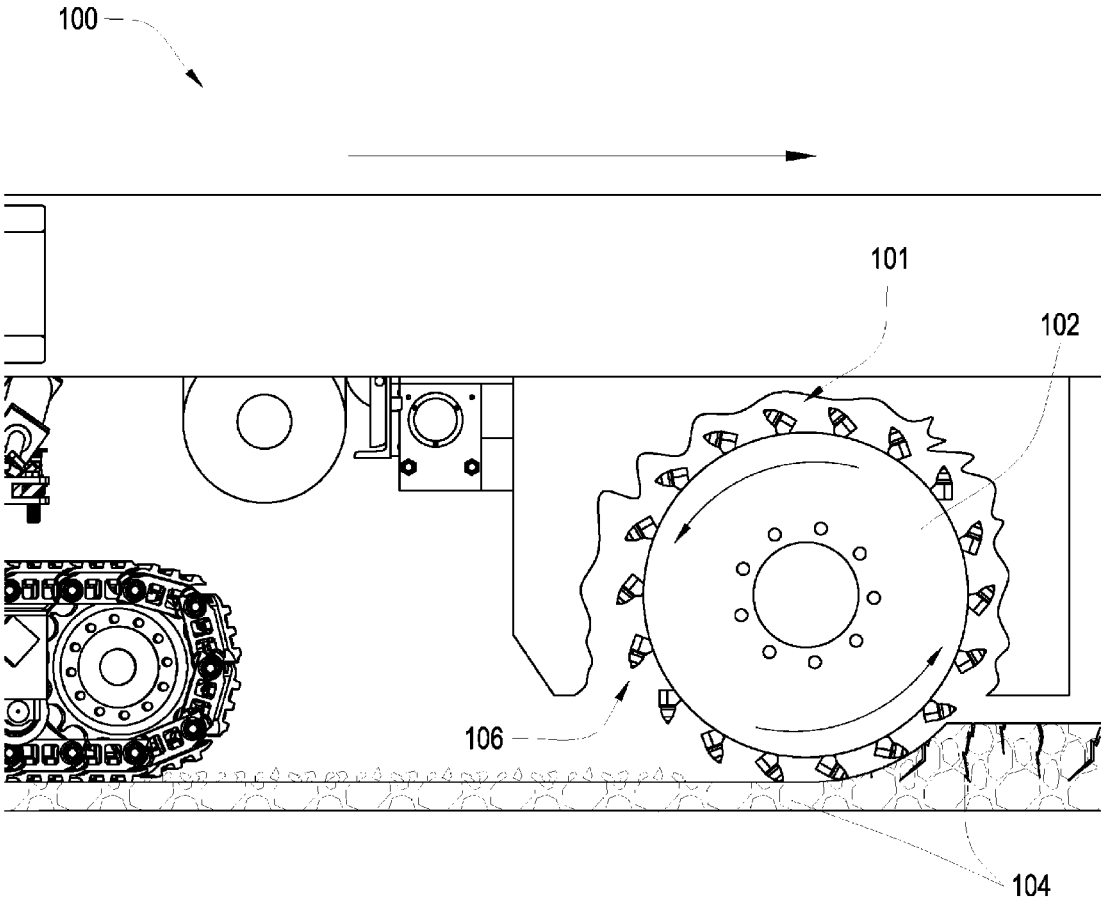
FIG. 1 is a side elevation view of one embodiment of a pavement milling machine.

FIG. 1 is a side elevation view of one embodiment of a pavement milling machine 100. A plurality of holder assemblies 101 are attached to a rotating drum 102 connected to the underside of a pavement milling machine 100. The pavement milling machine 100 may be a cold planer used to degrade man-made formations, such as pavement 104, prior to the placement of a new layer of pavement 104. Holder assemblies 101 may be attached to the rotating drum 102 at an angle, thereby bringing the holder assemblies 101 into engagement with the pavement 104 at the desired level of aggressiveness. A pick 106 may be inserted into a holder assembly 101. As the rotating drum 102 rotates in the direction shown by the arrows, the picks 106 temporarily contact the pavement 104. The impact from this contact causes the degradation of the pavement 104, as well as eventually wearing of the picks 106. Rotating drums 102 according to the present invention may also be used in mining machines, trenching machines, and in other applications.

Figure 2:
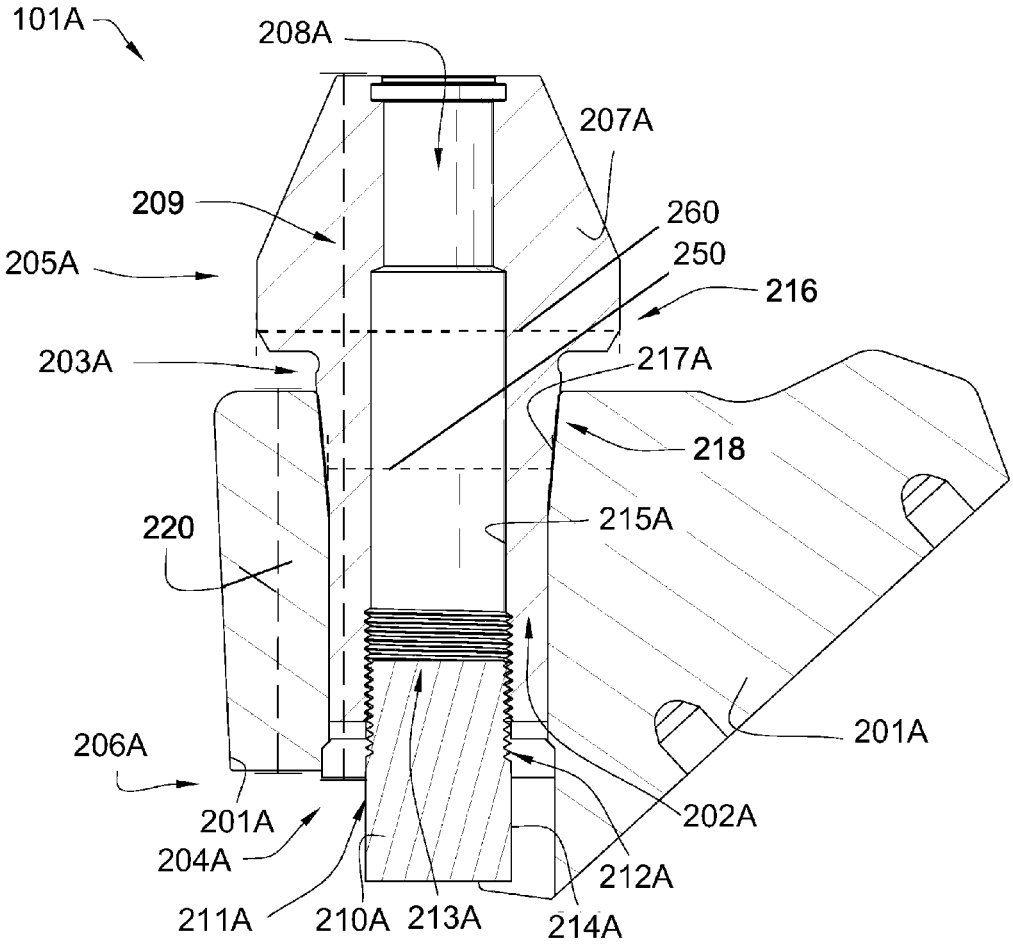
FIG. 2 is a cross-sectional view of one embodiment of a holder assembly.

FIG. 2 is a cross-sectional view of one embodiment of a holder assembly 101A. The holder assembly 101A comprises a connection block 201A that has a block bore 202A having a bore diameter 250 and which extends from a first opening 203A proximate a first end 205A of the holder assembly 101A to a second opening 204A proximate a second end 206A of the holder assembly 101A. The connection block 201A is adapted for connection to a driving mechanism, such as the rotating drum 102 of FIG. 1. In some embodiments, such as the embodiment of FIG. 1, the driving mechanism may be a rotating drum 102 connected to the underside of a pavement milling machine 100 or another part of a pavement milling machine 100.

An extension element 207A is disposed in the block bore 202A and protrudes from the first opening 203A of the block bore 202A. The extension element 207A comprises a central extension bore 208A that has a longitudinal length 209. The block bore 202A may also comprise a longitudinal length 220. The central extension [[bore]] bore's 208A longitudinal length 209 may be at least as long as the block [[bore]] bore's 202A longitudinal length 220.

In the present embodiment, an attachment mechanism 210A is inserted into the central extension bore 208A through the second opening 204A of the block bore 202A. The central extension bore 208A of the extension element 207A comprises an opening 211A proximate to the second end 206A of the holder assembly 101A. The attachment mechanism 210A protrudes from the second opening 204A of the block bore 202A. The attachment mechanism 210A comprises a first set of threads 212A that are disposed on an outer surface 214A of the attachment mechanism 210A. The first set of threads 212A corresponds with a second set of threads 213A that is disposed on an inner surface 215A of the central extension bore 208A. By mating the first and second sets of threads 212A, 213A, the attachment mechanism 210A may be mechanically coupled to the extension element 207A. In the present embodiment, the attachment mechanism 210A is attached to the extension element 207A within the block bore 202A of the connection block 201A.

The extension element 207A may also include a flange 216 having a flange diameter 260, the flange 216 being proximate to the first end 205A of the holder assembly 101A. The flange 216 proximate to the first end 205A prevents the extension element 207A from further entering the block bore 202A because the flange diameter 260 is greater than the bore diameter 250 and the extension element 207A is therefore too large to enter the block bore 202A at the flange 216. The attachment mechanism 210A proximate to the second end 206A effectively attaches the extension element 207A to the connection block 201A proximate to the second end 206A and may thereby effectively prevent the extension element 207A from being removed from the second end 206A of the holder assembly 101A. Together, the flange 216 prevents the extension element 207A from further entering the block bore 202A and the attachment mechanism 210A prevents the extension element 207A from being removed from the second end 206A, thereby helping to secure the extension element 207A stationary with respect to the connection block 201A. The extension element 207A is then attached to the connection block 201A via the attachment mechanism 210A.

In some embodiments, an internal surface 217A of the block bore 202A may comprise an outwardly tapered surface 218. The outwardly tapered surface 218 may allow the attachment mechanism 210A to secure the extension element 207A to the connection block 201A. With the attachment mechanism 210A mechanically coupled to the extension element 207A, the attachment mechanism 210A may be considered to be interlocked with the extension element 207A. Other types of interlocking or interconnection between the attachment mechanism 210A and the extension element 207A may also be consistent with the present invention.

Figure 3:
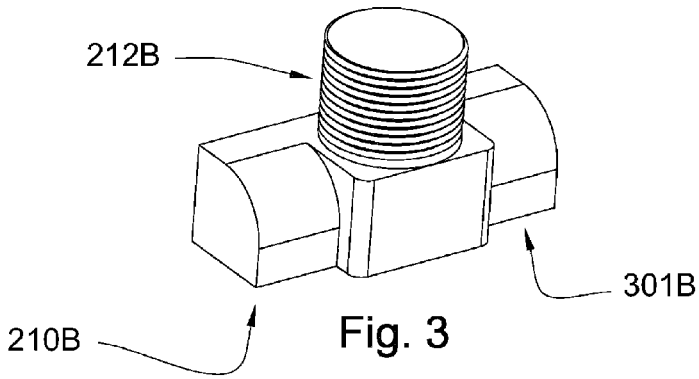
FIG. 3 is a perspective view of one embodiment an attachment mechanism.

FIG. 3 discloses a perspective view of one embodiment of an attachment mechanism 210B comprising a first set of threads 212B as previously discussed. The attachment mechanism 210B of FIG. 3 also comprises an external end 301B. Referring to FIG. 2, the external end 301B may protrude out of the second opening 204A of the block bore 202A and may interlock with or contact the connection block 201A.

Figure 4:
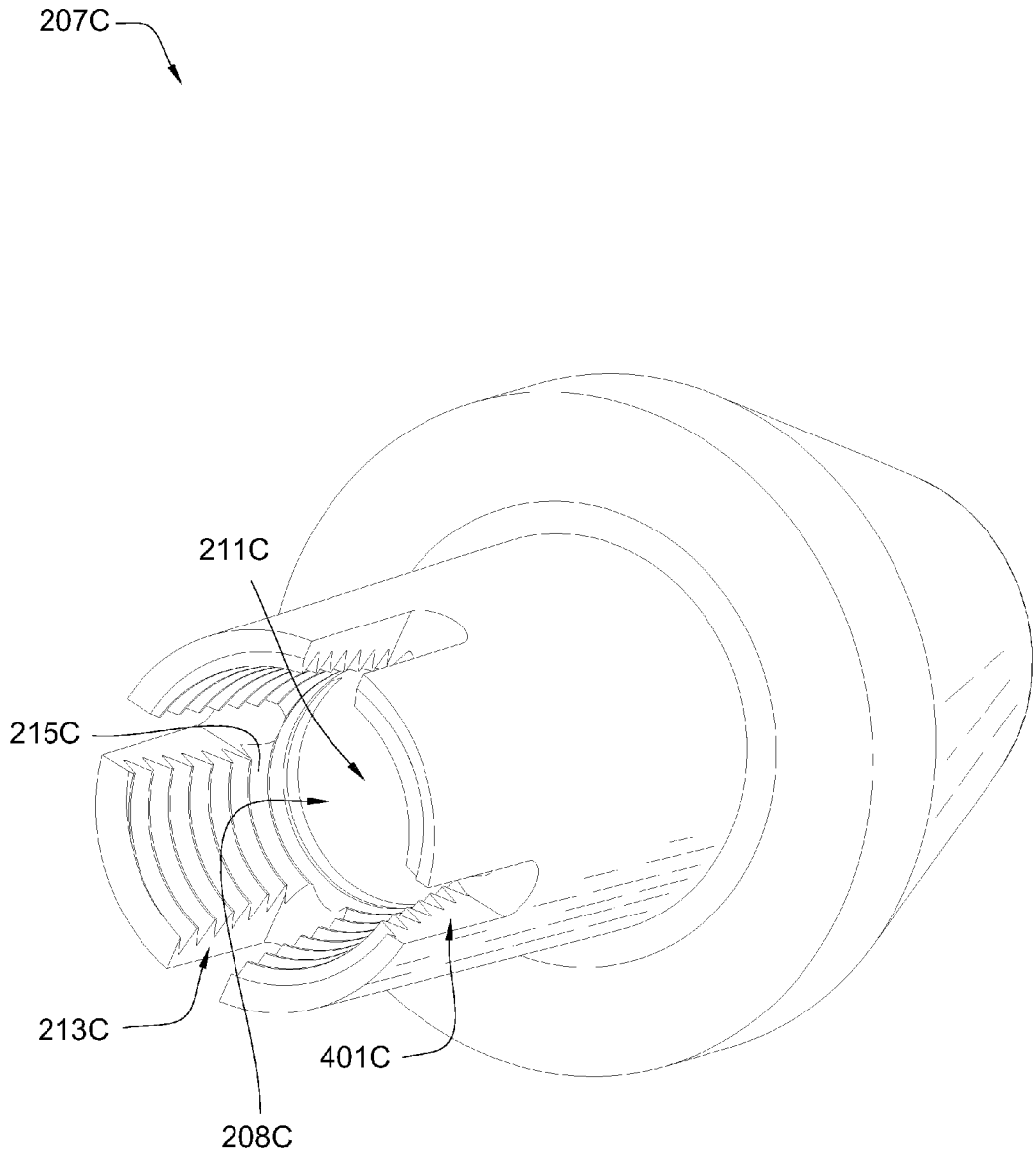
FIG. 4 is a perspective view of one embodiment of an extension element.
Figure 12:
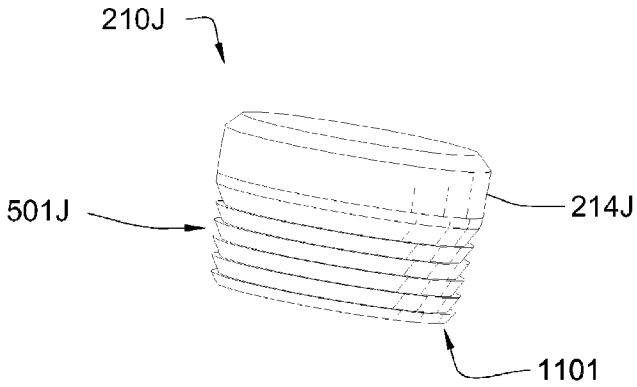
FIG. 12 is a perspective view of an embodiment of a wedge.

FIG. 4 discloses a perspective view of one embodiment of an extension element 207C comprising a second set of threads 213C on an inner surface 215C of a central extension bore 208C. The extension element 207C also comprises slits 401C proximate to a second end of a holder assembly, such as the second end 206A of the holder assembly 101A of FIG. 2. When an attachment mechanism (not shown) is inserted into an opening 211C of the central extension bore 208C, the attachment mechanism may radially expand a portion of the extension element 207C proximate to the slits 401C. This expansion may cause the extension element 207C to engage an internal surface 217 of block bore such as the internal surface 217A of the block bore 202A of FIG. 2. In some embodiments, the attachment mechanism may comprise a wedge 501J as shown in FIG. 12.

Figure 5:
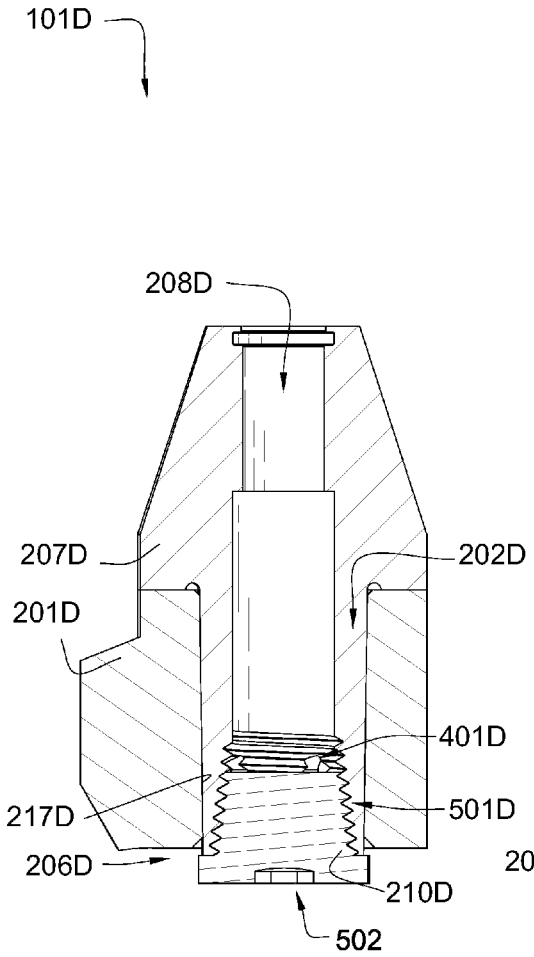
FIG. 5 is a cross-sectional view of another embodiment of a holder assembly.

FIG. 5 discloses a cross-sectional view of an embodiment of a holder assembly 101D with an attachment mechanism 210D threaded into an extension element 207D and comprising a wedge 501D. The wedge 501D of the attachment mechanism 210D is disposed within a central extension bore 208D of the extension element 207D. The extension element 207D may comprise slits 401D proximate to a second end 206D of the holder assembly 101D. The extension element 207D may be forced to engage an internal surface 217D of a block bore 202D by the wedge 501D as the attachment mechanism 210D is threaded into the extension element 207D. In FIG. 5, the attachment mechanism 210D comprises a hexagonally shaped receptacle 502. The hexagonally shaped receptacle 502 may be adapted for use with a hex key, also known as, a hex wrench or an Allen wrench.

Figure 6:
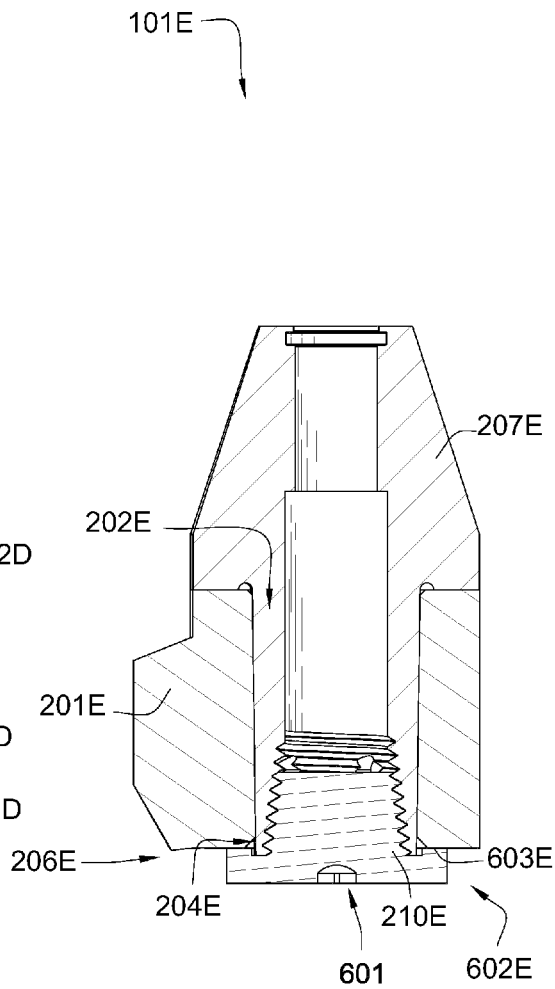
FIG. 6 is a cross-sectional view of another embodiment of a holder assembly.

FIG. 6 discloses a cross-sectional view of an embodiment of a holder assembly 101E in which the attachment mechanism 210E comprises an external end 602E that protrudes out of a second opening 204E of a block bore 202E. The external end 602E contacts a surface 603E of a connection block 201E proximate to a second end 206E of the holder assembly 101E when the attachment mechanism 210E is fully threaded into an extension element 207E. In FIG. 6, the attachment mechanism 210E comprises a polygonal receptacle 601. The polygonal receptacle 601 may be adapted for use with a regular screw driver or some other generally flat, turnable device. In other embodiments, the attachment mechanisms 210E may comprise a receptacle adapted for use with a Phillips screwdriver or some other type of turnable device. In still other embodiments, there is no receptacle. In such embodiments, the external end 602E may be adapted for use with wrench flats (not shown) about its periphery and in other embodiments, the attachment mechanism 210E is adapted to be hand tightened. Further, in the embodiment shown in FIG. 6, the external end 602E may abut against the connection block 201E, thereby pulling down on the extension element 207E and holding it snugly in place.

FIGS. 7-10 disclose various embodiments of a holder assembly 101F, 101G, 101H, 101I in which a pick shank 701F, 701G, 701H, 701I is disposed within a central extension bore 208F, 208G, 208H, 208I of a extension element 207F, 207G, 207H, 207I and the pick shank 701F, 701G, 701H, 701I is connected to a wear-resistant impact tip 702. In each embodiment, a carbide bolster 703F, 703g, 703H, 703I is disposed between the pick shank 701F, 701G, 701H, 701I and the wear-resistant impact tip 702 and is adapted as a means of connecting the pick shank 701F, 701G, 701H, 701I and the wear-resistant impact tip 702. In some embodiments, the pick shank 701F, 701G, 701H, 701I and wear-resistant impact tip 702 may be connected to one another without a carbide bolster 703F, 703g, 703H, 703I. The wear-resistant impact tip 702 may comprise a superhard material with a hardness greater than 4000 HK. The superhard material may include diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

Figure 7:
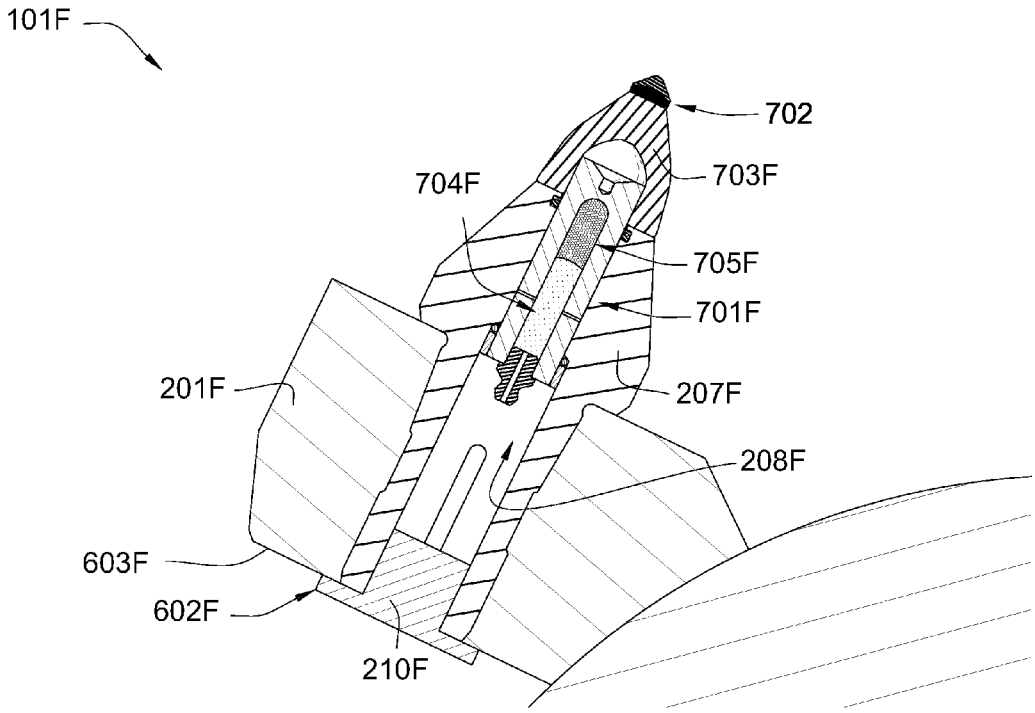
FIG. 7 is a cross-sectional view of one embodiment of a holder assembly and a pick.
Figure 8:
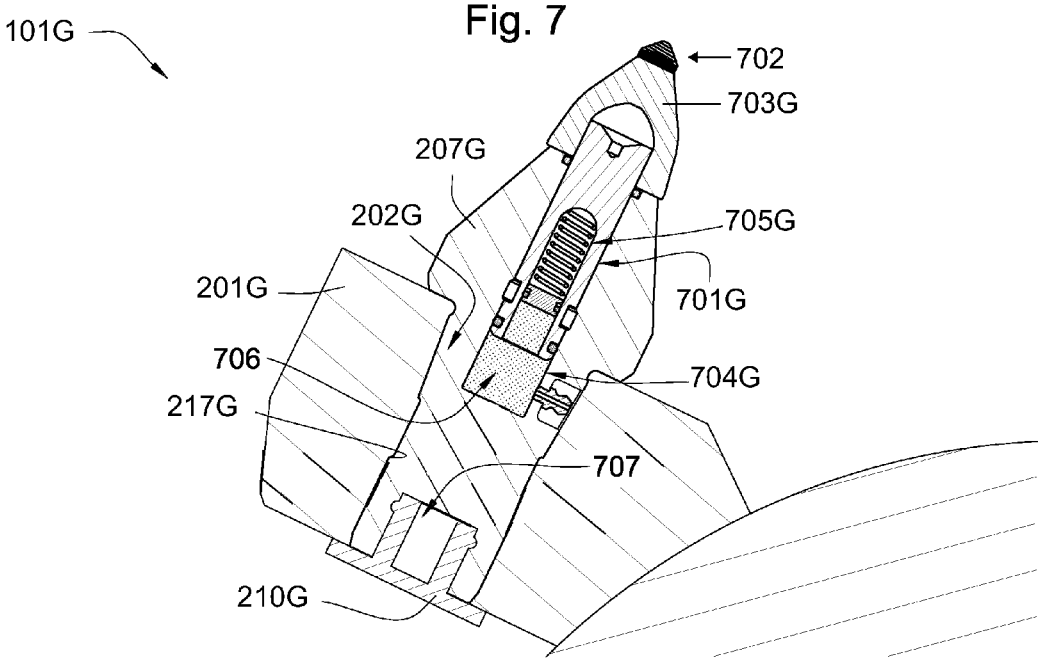
FIG. 8 is a cross-sectional view of another embodiment of a holder assembly and a pick.
Figure 9:
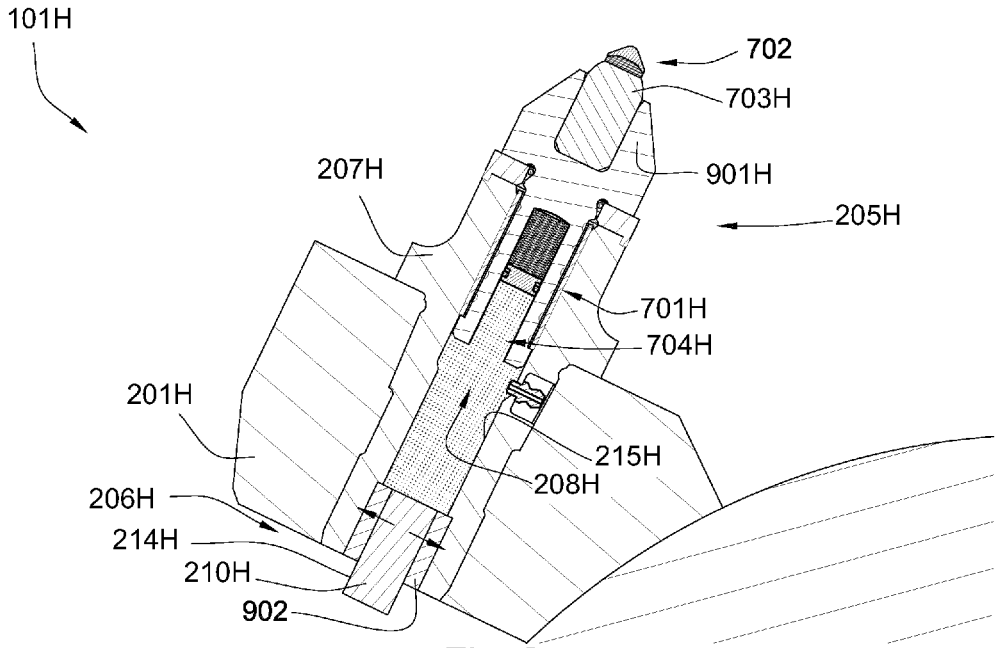
FIG. 9 is a cross-sectional view of another embodiment of a holder assembly and a pick.

FIGS. 7-9 also disclose embodiments in which a lubricant reservoir 704F, 704G, 704H and a pick shank 701F, 701G, 701H are each disposed in the central extension bore 208F, 208G 208H. In FIG. 7, the lubricant reservoir 704F is disposed within the pick shank 701F. In FIG. 8, the lubricant reservoir 704G is disposed within a primary central extension bore 208706, partially within the pick shank 701G and partially outside of the pick shank 701G. In both embodiments, the lubricant reservoir 704F, 704G may comprise a pressurization mechanism 705F, 705G to pressurize the lubricant reservoir 704F, 704G. In FIG. 7, the attachment mechanism 210F comprises an external end 602F that contacts the surface 603F of the connection block 201F. The attachment mechanism 210F may be press fit into the central extension bore 208F of the extension element 207F.

Referring specifically now to FIG. 8, the extension element 207G comprises a plurality of coaxial central extension bores 706, 707. The pick shank 701G and the lubricant reservoir 704G are each disposed in a primary central extension bore 706. The attachment mechanism 210G is at least partially disposed within a secondary central extension bore 707. The attachment mechanism 210G of FIG. 8 is adapted to interlock with the extension element 207G. In some embodiments, the attachment mechanism 210G may comprise a material having a characteristic of being biased towards the internal surface 217G of the block bore 202G.

Referring now to FIG. 9, the carbide bolster 703H is press fit into a steel body 901H that is disposed between the pick shank 701H and the carbide bolster 703H. The pick shank 701H and the lubricant reservoir 704H are disposed in the central extension bore 208H proximate to the a first end 205H. In this embodiment, the attachment mechanism 210H is disposed in the central extension bore 208H proximate to the second end 206H. A split ring 902 is disposed between the inner surface 215H of the central extension bore 208H and the outer surface 214H of the attachment mechanism 210H proximate the second end 206H of the holder assembly 101H. Pushing the attachment mechanism 210H into the split ring 902 may place places an outward force on the extension element 207H which pushes the extension element 207H outward to engage the connection block 201H.

Figure 10:
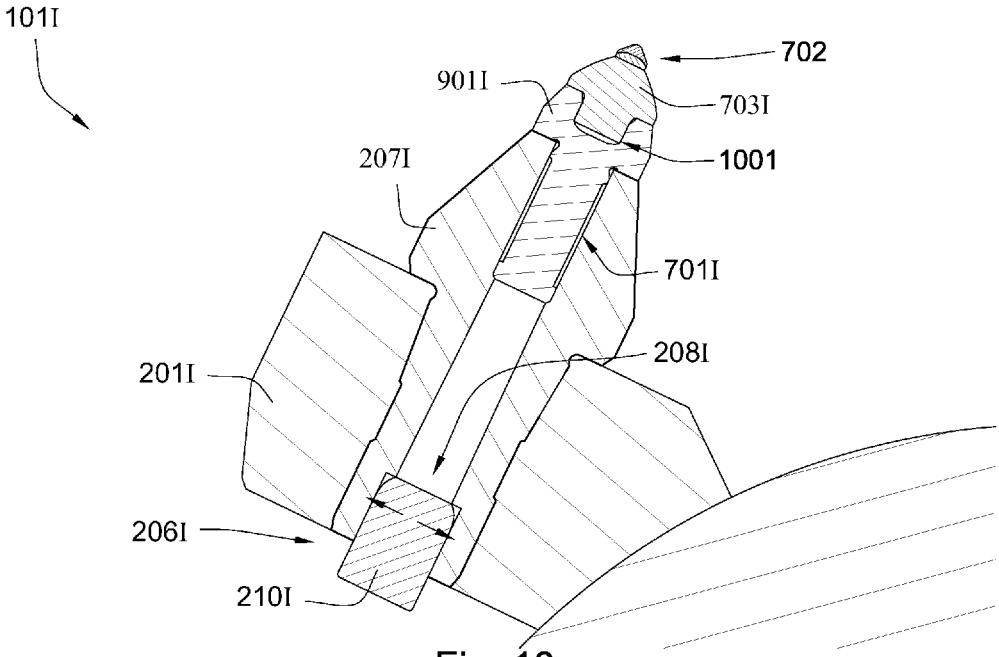
FIG. 10 is a cross-sectional view of another embodiment of a holder assembly and a pick.

FIG. 10 shows another embodiment of holder assembly 101I in which a carbide bolster 703I protrudes into a cavity 100I in a steel body 901I between the pick shank 701I and the wear-resistant impact tip 702. FIG. 10 also shows an embodiment in which the attachment mechanism 210I is press fit into a central extension bore 208I from the a second end 206I of the holder assembly 101I. This may causes the extension element 207I to engage the connection block 201I proximate to the second end 206I.

Figure 11:
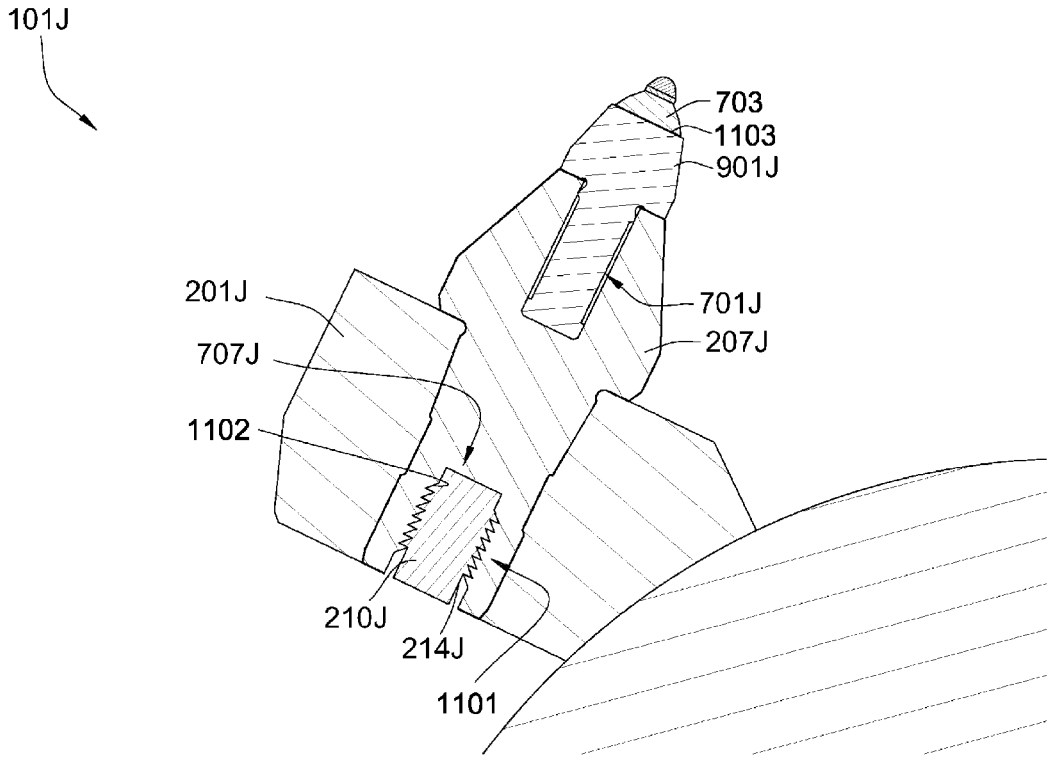
FIG. 11 is a cross-sectional view of another embodiment of a holder assembly and a pick.

Referring now to FIGS. 11, an embodiment of a holder assembly 101J is disclosed in which an outer surface 214J of an attachment mechanism 210J comprises ridges 1101. In the embodiment of FIG. 11, a secondary central extension bore 707J comprises recesses 1102 into which the ridges 1101 of the attachment mechanism 210J may interlock. As shown in FIG. 12, the attachment mechanism 210J may comprise a wedge 501J. FIG. 11 also discloses an embodiment of the invention in which a carbide bolster 703J is brazed to a steel body 901J at a planar interface 1103.

Whereas the present invention has been described in particular relation to the drawings attached hereto, it should be understood that other and further modifications apart from those shown or suggested herein, may be made within the scope and spirit of the present invention.

What is claimed is:

1. A holder assembly for securing a pick, said holder assembly comprising:

a connection block including a block bore having a bore diameter and a first longitudinal length extending from a first opening proximate a first end of the connection block to a second opening proximate a second end of the connection block;

an extension element comprising:

a central extension bore including a second longitudinal length that is greater than the first longitudinal length of the block bore and bore threads on at least a portion of an inner surface of the central extension bore, said central extension bore being adapted to receive said pick; and a flange positioned proximate to the first end of the connection block and adapted for abutting the connection block, the flange including a flange diameter that is greater than the bore diameter of the block bore; and wherein the extension element is disposed in the block bore of the connection block and protrudes out from the first opening of the block bore;

an attachment mechanism including complementary threads on at least a portion of an outer surface of the attachment mechanism adapted to threadably engage the bore threads to interconnect the extension element and the connection block, the attachment mechanism adapted for insertion into the central extension bore through the second opening of the block bore and being disposed proximate the second end of the connection block.

2. The holder assembly of claim 1, wherein the attachment mechanism attaches to the extension element within the block bore of the connection block.

3. The holder assembly of claim 1, wherein at least a portion of an internal surface of the block bore is tapered outward.

4. The holder assembly of claim 1, wherein the attachment mechanism is adapted to radially expand at least a portion of the extension element outward to engage an internal surface of the block bore.

5. The holder assembly of claim 4, wherein the attachment mechanism comprises a wedge.

6. The holder assembly of claim 1, wherein at least a portion of an external surface of the extension element is tapered inward, and wherein an outer surface of the central extension bore is substantially cylindrical.

7. The holder assembly of claim 1, wherein the attachment mechanism is adapted to interlock with the extension element.

8. The holder assembly of claim 1, wherein the central extension bore of the extension element includes an opening proximate the second end of the connection block.

9. The holder assembly of claim 1, wherein the extension element further includes a plurality of coaxial central extension bores.

10. The holder assembly of claim 9, wherein a lubricant reservoir and a pick shank are each disposed within at least one of the plurality of coaxial central extension bores.

11. The holder assembly of claim 1, wherein an internal surface of the block bore includes outwardly tapered surfaces.

12. The holder assembly of claim 1, wherein the outer surface of the attachment mechanism includes at least one slit proximate the complimentary threads.

13. The holder assembly of claim 1, wherein the extension element includes slits proximate the second end of the connection block.

14. The holder assembly of claim 1, wherein the attachment mechanism protrudes from the second opening of the block bore.

15. The holder assembly of claim 1, wherein the attachment mechanism includes an external end that protrudes out of the second opening of the block bore and contacts a surface of the connection block proximate the second end of the connection block.

16. The holder assembly of claim 1, wherein a pick shank is secured within the central extension bore and the pick shank is interconnected to a wear-resistant impact tip.

17. The holder assembly of claim 1, wherein the connection block is adapted for interconnection to a driving mechanism, and wherein the driving mechanism is a milling drum interconnected to at least one of an underside of a pavement milling machine and a part of a pavement milling machine.

18. A holder assembly for securing a pick, the holder assembly comprising:

a connection block including a first end, a second end, and a block bore extending therebetween, the block bore including a block bore length;

an extension element positioned within the block bore and including a first extension end, a second extension end, and a central extension bore extending therebetween, the first extension end being adapted to secure said pick shank, the central extension bore including a central extension bore length and bore threads on an inner surface, wherein the central extension bore length is greater than the block bore length; and an attachment mechanism positioned proximate to the second end of the connection block, the attachment mechanism including complementary threads on an outer surface for engaging the bore threads and for selectively interconnecting the connection block and the extension element.

19. The holder assembly of claim 18, wherein at least a portion of an internal surface of the block bore is tapered outward.

20. The holder assembly of claim 18, wherein at least a portion of an external surface of the extension element is tapered inward, and wherein an outer surface of the central extension bore is substantially cylindrical.

21. The holder assembly of claim 18, wherein the extension element further includes a flange positioned proximate to the first end of the connection block, wherein a diameter of the flange is greater than a diameter of the block bore, and wherein the flange is adapted for contacting at least a portion of the connection block.

22. The holder assembly of claim 18, wherein the central extension bore is adapted for receiving a pick shank.

* * * * *